US006931821B2

(12) United States Patent
Wong

(10) Patent No.: US 6,931,821 B2
(45) Date of Patent: Aug. 23, 2005

(54) TAMPER EVIDENT VIAL CAP AND INTEGRITY ASSURANCE METHOD

(75) Inventor: Johnson N. S. Wong, Rolling Hills, CA (US)

(73) Assignee: Evergreen Industries, Inc., Los Angeles, CA (US)

( * ) Notice: Subject to any disclaimer, the term of this patent is extended or adjusted under 35 U.S.C. 154(b) by 208 days.

(21) Appl. No.: 10/630,192

(22) Filed: Jul. 29, 2003

(65) Prior Publication Data

US 2005/0023238 A1 Feb. 3, 2005

(51) Int. Cl.[7] ..... B65B 43/40; B65B 7/28

(52) U.S. Cl. ..... 53/420; 53/468; 53/471; 53/492; 215/250; 220/265; 422/102

(58) Field of Search ..... 53/109, 381.4, 53/420, 468, 471, 490, 492; 206/807; 215/250; 220/265; 422/102

(56) References Cited

U.S. PATENT DOCUMENTS

| | | | | | |
|---|---|---|---|---|---|
| 3,892,327 | A | * | 7/1975 | Leitz | 215/250 |
| 3,974,938 | A | * | 8/1976 | Steadman | 215/250 |
| 4,351,442 | A | | 9/1982 | Summers | |
| 4,363,338 | A | * | 12/1982 | Brown | 53/381.4 |
| 4,453,666 | A | * | 6/1984 | Gordon | 206/807 |
| 4,503,986 | A | | 3/1985 | Nixdorff et al. | |
| 4,541,536 | A | | 9/1985 | Davis et al. | |
| 4,782,977 | A | * | 11/1988 | Watanabe et al. | 220/324 |
| 4,807,425 | A | * | 2/1989 | Abrams | 53/468 |
| 4,873,193 | A | | 10/1989 | Jensen et al. | |
| 4,889,249 | A | | 12/1989 | Hulon | |
| 4,917,867 | A | | 4/1990 | Jensen et al. | |
| 4,934,547 | A | * | 6/1990 | Mayes et al. | 215/250 |
| 5,042,226 | A | * | 8/1991 | Osip et al. | 53/420 |
| 5,056,675 | A | | 10/1991 | Julian | |
| 5,069,878 | A | | 12/1991 | Ehrenkranz | |
| 5,090,583 | A | | 2/1992 | Hoffman et al. | |
| 5,133,470 | A | * | 7/1992 | Abrams et al. | 215/250 |
| 5,215,204 | A | | 6/1993 | Beck et al. | |
| 5,246,125 | A | | 9/1993 | Julian | |
| 5,307,945 | A | | 5/1994 | Hidding et al. | |
| 5,318,192 | A | | 6/1994 | Rebeyrolle et al. | |
| 5,360,127 | A | | 11/1994 | Barriac et al. | |
| 5,385,252 | A | | 1/1995 | Hidding et al. | |
| 5,450,973 | A | | 9/1995 | Ellis et al. | |
| 5,544,768 | A | | 8/1996 | Gargione | |
| 5,593,054 | A | | 1/1997 | Glynn | |
| 5,657,905 | A | | 8/1997 | Glynn | |
| 5,690,243 | A | | 11/1997 | Molinaro | |
| 5,725,115 | A | | 3/1998 | Bosl et al. | |
| 5,749,484 | A | | 5/1998 | Trout | |
| 5,819,965 | A | | 10/1998 | King et al. | |
| 6,039,196 | A | | 3/2000 | Ekkert et al. | |
| 6,044,992 | A | | 4/2000 | Ma | |
| 6,370,701 | B1 | | 4/2002 | Siegrist | |
| 6,439,412 | B2 | | 8/2002 | Luch | |
| 6,523,710 | B1 | | 2/2003 | Hidding et al. | |

* cited by examiner

*Primary Examiner*—John Sipos
(74) *Attorney, Agent, or Firm*—Fulbright & Jaworski

(57) ABSTRACT

A tamper evident cap assembly, more particularly a combination of vial and cap assembly, assures the integrity of a specimen and of the specimen collection process. The screw cap is locked to the screw threads of a vial, when the vial is empty, with one of two latches that are integral to the cap assembly and can lock the cap to the vial. The lock is broken in the presence of the specimen donor or in the presence of a witness who can testify as to chain of custody, a specimen is placed in the vial, following which the cap is locked to the vial with the other of the two latches, which is broken when received by a testing laboratory. A loop formed to encircle the vial is connected by a tether to the cap and slipped onto the vial. At least one restraining rib on the vial is spaced below the screw thread top and is sized to permit the loop to be forced upwardly thereover to be restrained from downward movement. In addition, a limiting flange on the vial is spaced below the screw thread and above the loop restraining rib sufficient to accommodate the loop, and is sized to limit upward movement of the loop. In a specific embodiment, latch staples extend from the cap which can be inserted into, and irreversibly lock with, respective hasps extending from the loop.

15 Claims, 7 Drawing Sheets

FIG. 9
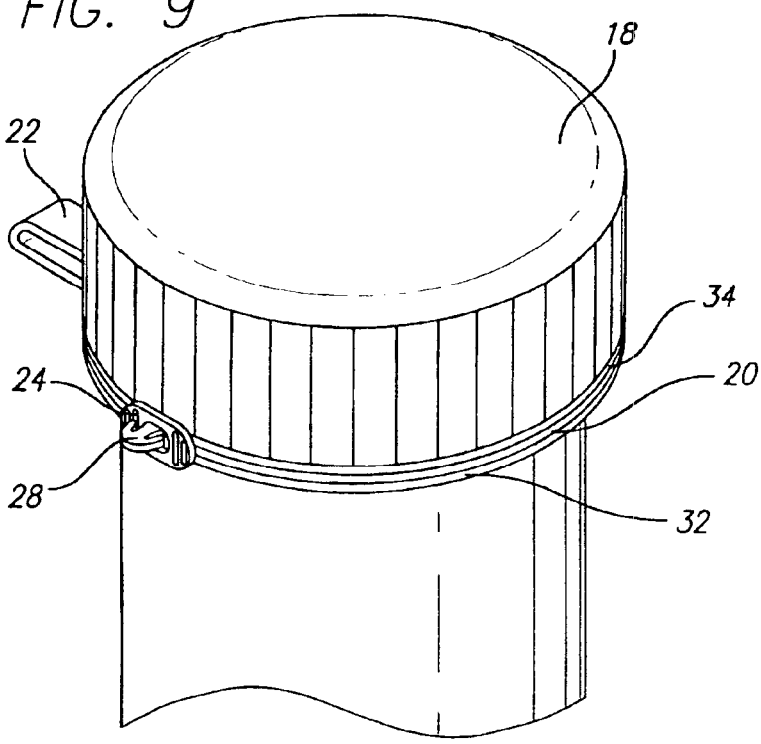
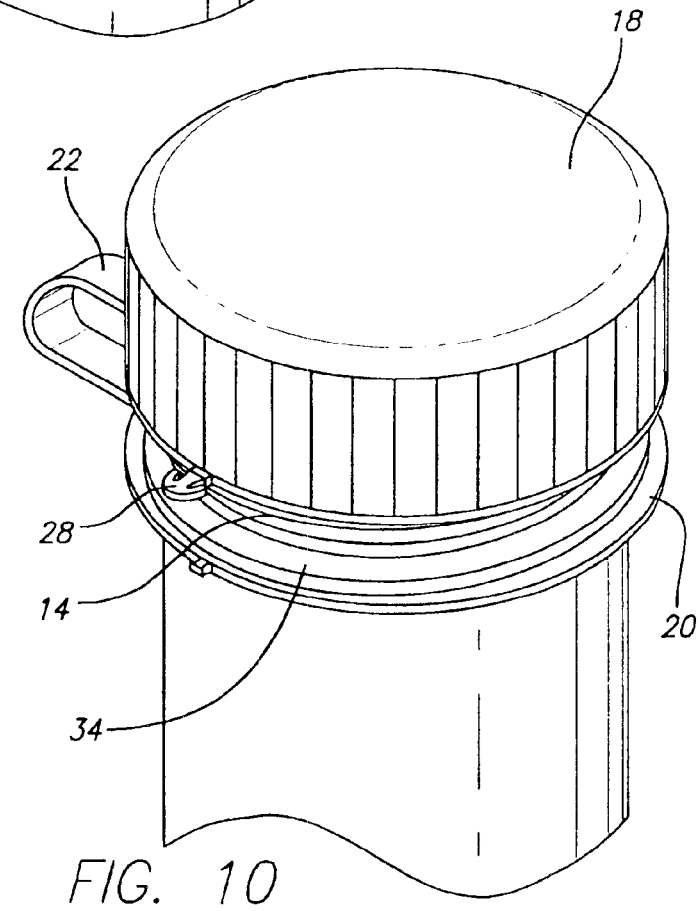
FIG. 10

TAMPER EVIDENT VIAL CAP AND INTEGRITY ASSURANCE METHOD

FIELD OF THE INVENTION

The invention relates to tamper evident vials and caps therefor, and to a method for assuring the integrity of specimen collection.

BACKGROUND OF THE INVENTION

Employers, government agencies, sports teams and other organizations have become increasingly involved in diagnostic testing to maintain safety in the workplace and to assure compliance with laws, rules and regulations. The presence of a predetermined analyte (e.g. drugs and/or disease) is determined by collecting biological fluids, i.e., urine, blood, sputum, pleural, cavity and peritoneal cavity fluids, for analysis. It is often vital in conducting such tests to maintain the integrity of the collected biological fluid specimens by minimizing or eliminating any potential for specimen contamination and/or by preserving the chain of custody.

There are many and varied known devices for collecting specimens. A particular device consists of a vial fitted with a heavy-duty screw cap attached to the vial with a tether. The integrity of the device depends on a plastic, easily broken, thus tamper evident, tape that is sealed across the cap and vial. When the specimen is collected, the donor can see that the tape is unbroken, which remains unbroken until the screw cap is removed in the donor's presence. The specimen is then placed in the tube, the cap replaced and the capped tube is shipped to a testing lab.

There are a number of deficiencies in such a system, one of which being that once the tape is broken, there is no longer any tamper evident mechanism, and the chain of custody must be maintained by other means, for example by affidavits and/or testimony. Another deficiency is that if care is taken by someone dedicated to the task, such a tape seal can be removed to unscrew the cap, and then the cap and tape can be replaced without the tampering being evident. Particularly for demonstrating integrity and chain of custody in drug testing, there is a need for a reliable mechanism that enables the donor of the specimen to be assured not only that the container for the specimen is uncontaminated, but to also assure that it is sealed against contamination when shipped to a testing laboratory.

BRIEF SUMMARY OF THE INVENTION

The present overcomes the foregoing deficiencies by providing a tamper evident cap assembly of special construction, more particularly a combination of vial and cap assembly, assures the integrity of a specimen and of the specimen collection process. In accordance with one aspect of the invention, the cap is locked to the vial, when the vial is empty, with one of two latches that are integral to the cap assembly. The lock is broken in the presence of the specimen donor or in the presence of a witness who can testify as to chain of custody. A specimen is placed in the vial, following which the cap is locked to the vial with the other of the two latches also in the presence of the specimen donor or in the presence of a witness who can testify as to chain of custody. The second latch is broken when received by a testing laboratory.

In a particular embodiment, the vial is provided with a screw thread top and the tamper evident cap can be screwed onto the vial. A loop formed to encircle the vial is connected by a tether to the cap and slipped onto the vial. At least one restraining rib on the vial is spaced below the screw thread top and is sized to permit the loop to be forced upwardly thereover to be restrained from downward movement. In addition, at a limiting circumferential flange on the vial is spaced below the screw thread and above the loop restraining rib sufficient to accommodate the loop, and is sized to limit upward movement of the loop.

The two latches are each capable of locking the cap to the vial, each latch having a component extending from the loop and a corresponding component extending from the cap lockable to the loop component when the cap is screwed onto the vial, preferably irreversibly lockable. In a particular embodiment, one of the components of each latch is a latch staple and the corresponding locking component of each of said latches is a hasp. In a more specific embodiment, latch staples extend from the cap which can be inserted into, and lock with, respective hasps extending from the loop.

BRIEF DESCRIPTION OF THE DRAWINGS

For a more complete understanding of the present invention, reference is now made to the following descriptions taken in conjunction with the accompanying drawing, in which:

FIG. 9 is a perspective view of the cap—tether ring—vial screw thread, showing one of the hasps locked onto the corresponding latch staple, locking the cap to the vial;

FIG. 10 is a perspective view of the cap—tether ring—vial screw thread of FIG. 9 but wherein the cap and tether ring have been rotated so that the threads cause separation thereof and breaking of the latch—hasp connection of FIG. 9.

DETAILED DESCRIPTION OF THE INVENTION

Figure 1:
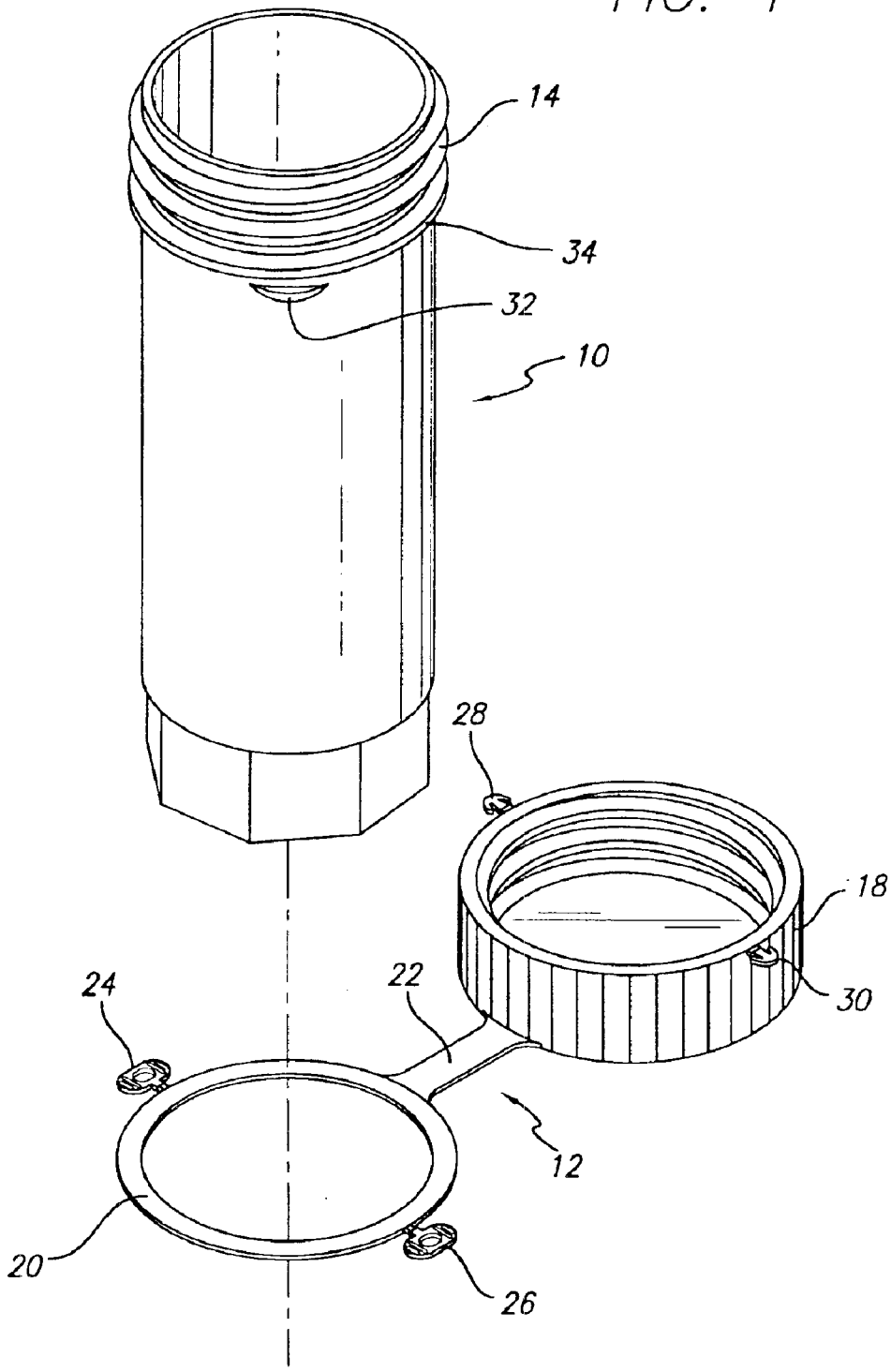
FIG. 1 is a perspective, exploded view of a specimen vial and tamper evident cap, showing the cap and its tether loop in position to be assembled, the cap being formed with a pair of latch staples, the tether loop being formed with a pair of corresponding female hasps.

Referring to FIGS. 1–4, a combination of vial 10 and tamper evident cap assembly 12 are provided. Except as described below, the vial 10 has generally a known construction for a specimen vial formed with a screw thread top 14. The vial 10 can be provided with an octagon—shaped bottom 16 to fit into an automatic analyzer, but that is not itself part of the invention. The cap assembly 12 consists of a heavy-duty screw cap 18 to which a retaining loop is connected by a tether 22. Except for the latching components described below, the cap—tethered loop assembly 12 also has generally a known construction.

In accordance with the invention, the cap assembly and vial are each modified from the prior art to provide locking latches that enable the combination to be tamper evident and to provide a unique method of assuring the integrity and chain of custody of specimen collection. In particular, the retaining loop 20 is provided with a pair of hasps 24 and 26 and the cap 18 is provided with corresponding latch staples 28 and 30, each of which are described in more detail below. The vial 10 is modified by providing with restraining ribs 32 around the circumference of the vial 10 spaced below the screw thread top 14 and which are sized to permit the loop 20 to be forced upwardly thereover to be restrained from downward movement. In addition, a limiting circumferential flange 34 (see particularly FIG. 4) on the vial is spaced below the screw thread 14 and above the loop restraining ribs 32 sufficient to accommodate the loop 20, and is sized to limit upward movement of the loop 20.

Figure 2:
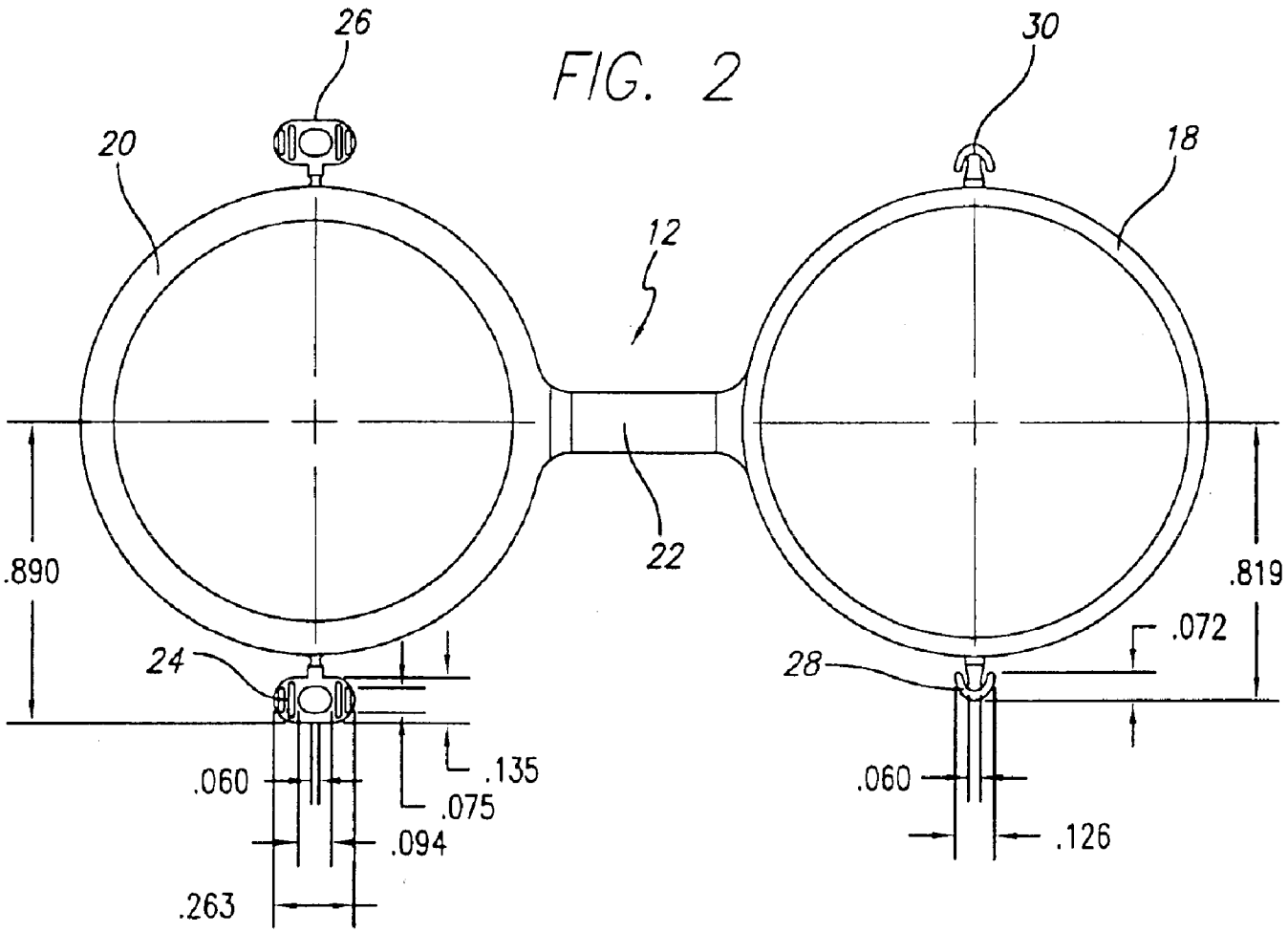
FIG. 2 is a plan view of the cap and its tether loop.
Figure 3:
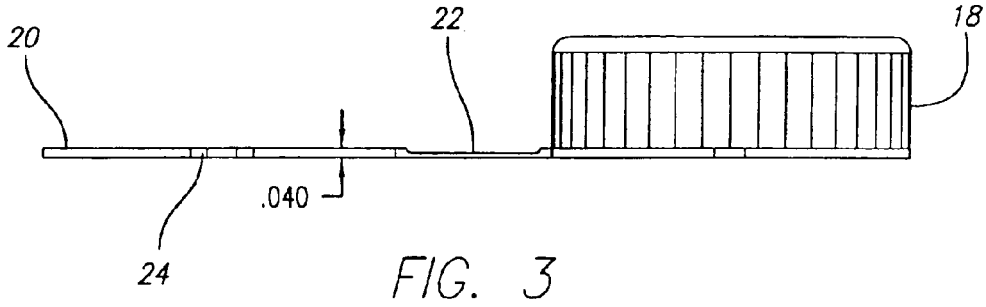
FIG. 3 is an elevational view of the cap and its tether loop.
Figure 4:
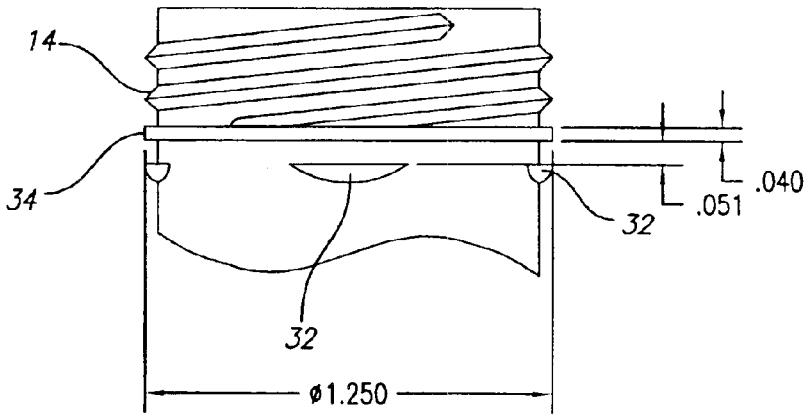
FIG. 4 is a detailed elevational view of the vial screw thread.

Dimensions for a specific implementation are given in FIGS. 2, 3 and 4. It will be appreciated that alternative structures can be provided for the ribs 32 and for the flange 34. In place of a plurality of ribs 32, one can use even a single rib, or single flange. Similarly, the circumferential flange 34 can be replaced by one or more ribs.

Figure 5:
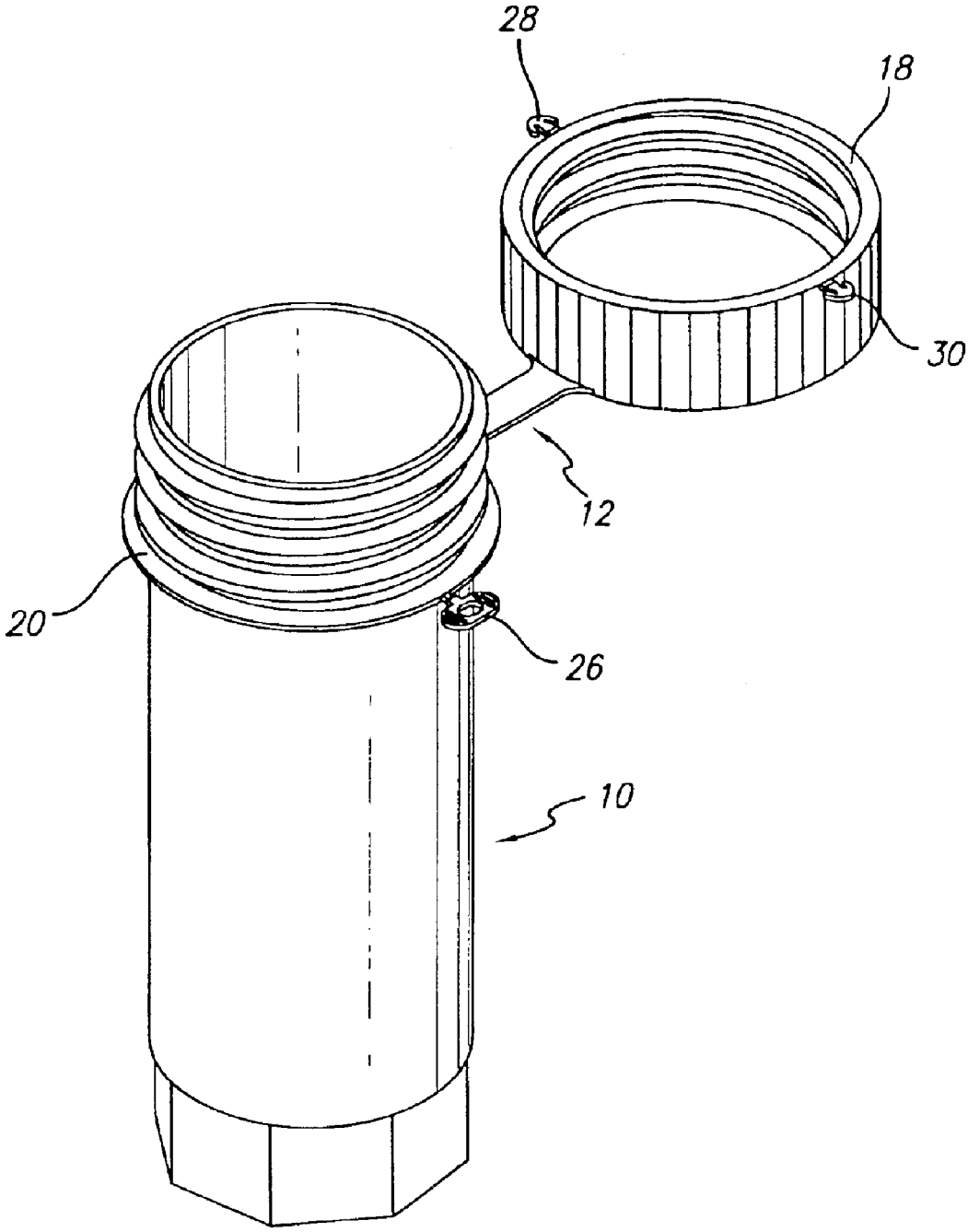
FIG. 5 is a perspective view of the specimen vial and tamper evident cap, showing the cap and its tether loop assembled and ready to be closed.

The assembled combination of vial 10 and tamper evident cap assembly 12 is shown in FIG. 5 wherein the vial 10 has been inserted into the loop 20 which has been forced upwardly over the ribs (not shown in FIG. 5) and secured between the ribs and the flange 34. Though secured, the loop 20 is free to rotate, so that the cap 18 can be screwed onto the screw thread top 14 of the vial 10.

Figure 6:
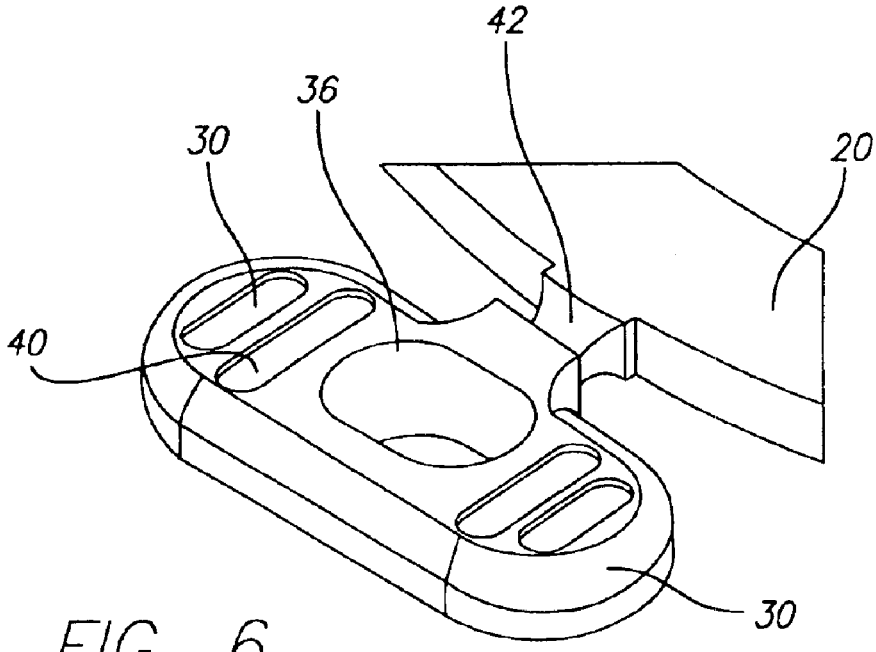
FIG. 6 is a detailed perspective view of one of the tether loop hasps.
Figure 7:
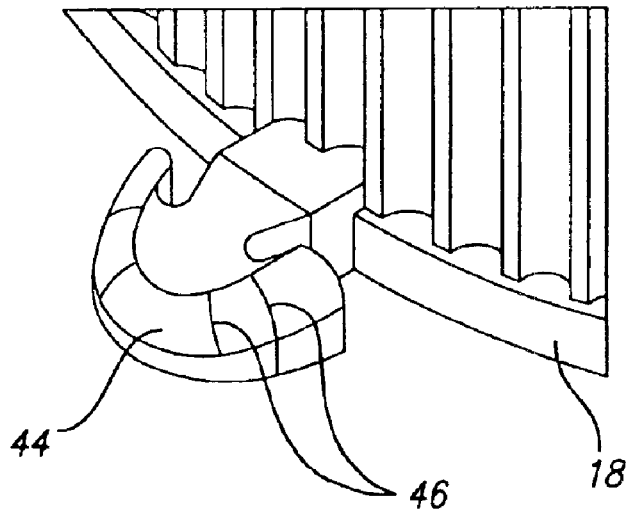
FIG. 7 is a detailed perspective view of one of the cap latch staples.

The hasps 24 (not shown in FIG. 5) and 26 and corresponding latch staples 28 and 30 fit together in such manner as to provide irreversibly locked latches. One of the hasps, 30, extending from the loop 20 is shown in detail in FIG. 6 and is formed with a central slot 36, relieved sections such as at 38 and 40, and a thinned neck 42 serving as an easily breakable line of weakness. One of the latch staples, 44, extending from the open edge of the cap 18 is formed in the shape of a double hook, formed with lines of weakness that serve to enable the staple 44 to bend to be inserted into the central hasp slot 36, and which also serve to enable the staple to be easily broken.

Figure 8:
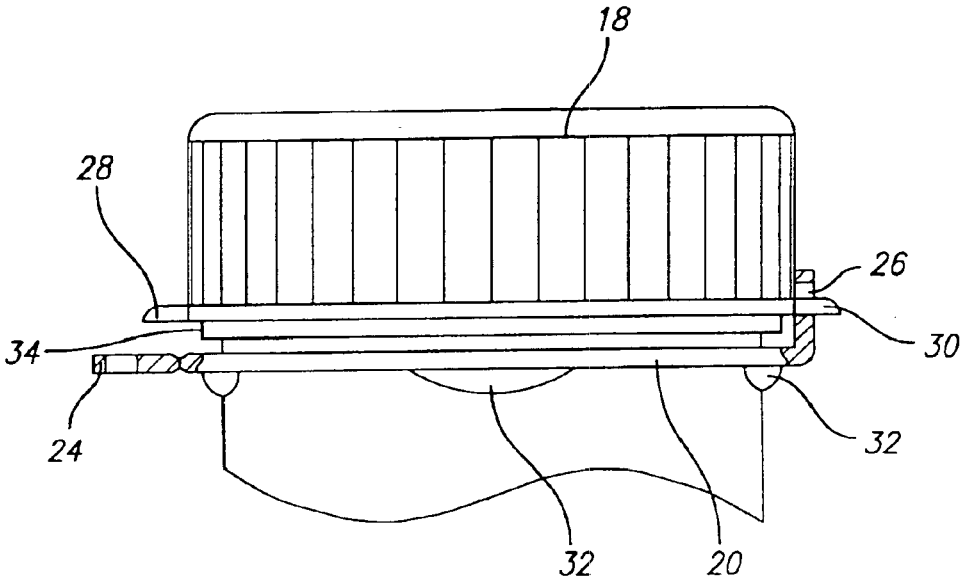
FIG. 8 is a detailed elevational view of the cap—tether ring—vial screw thread, showing movement of one of the hasps into locking engagement with the corresponding latch staple to lock the cap to the vial.

The manner by which one of the latch staples 28 is locked into a corresponding hasp 24 is shown in FIGS. 8 and 9. After the loop 20 is secured between the ribs 32 and flange 34, cap 18 is screwed clockwise onto the vial 10, the loop 20 turning with it via the tether 22 (FIG. 9). When the cap 18 is fully secured on the vial 10, the hasp 24 is rotated upwardly, as schematically shown, until the hook end of the staple 44 is forced into the central slot 36 of the hasp 24. The cap 18 is now irreversibly locked to the vial 10. As such it can be shown to the specimen donor, or a witness who can testify as to chain of custody, providing assurance that the vial is uncontaminated.

Referring to FIG. 10, to break the lock, also in the presence of the specimen donor or witness, one merely has to turn the cap 18 counterclockwise whereupon as the cap 18 rises on the vial screw top threads 14, the latch formed by the locked together staple 28 and hasp 24 (not shown in FIG. 10) is stretched until one or both of the staple and hatch components breaks. In FIG. 10, the hasp 24 has broken away, allowing the cap 18 to be removed.

Figure 11:
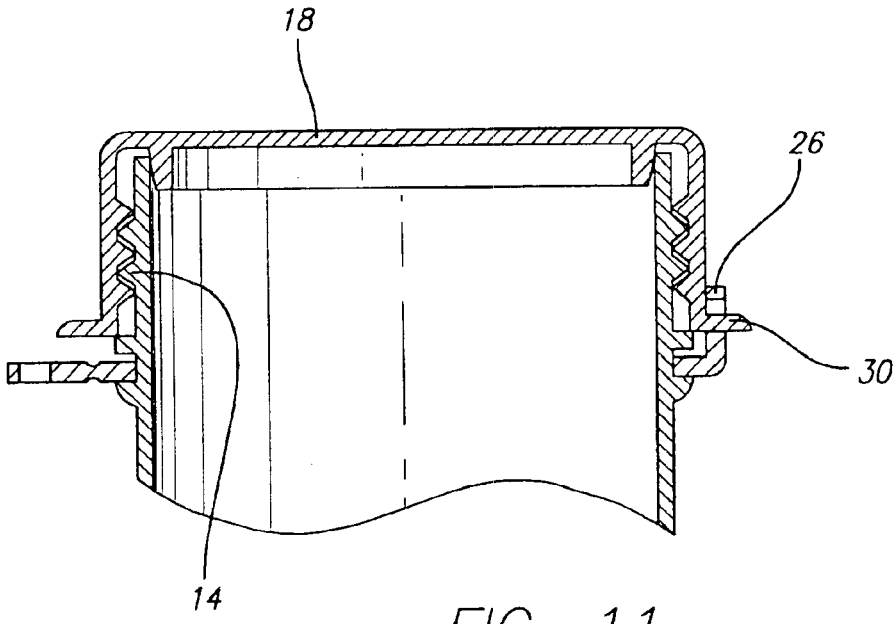
FIG. 11 is a cross-sectional view of the cap—tether ring—vial screw thread after breaking the latch—hasp connection as in FIG. 10, wherein the cap has been re-screwed onto the vial threads and the remaining hasp moved into locking engagement with the remaining latch staple to re-lock the cap to the vial.

A specimen is placed in the vial, following which the cap is locked to the vial with the other of the two latches, as shown in FIG. 11, formed by inserting the remaining staple 30 into the remaining hasp 26, also in the presence of the specimen donor or in the presence of a witness who can testify as to chain of custody. The vial containing the specimen is then sent to a testing laboratory where the second locked latch is broken, which also can be in the presence of a witness who can testify as to chain of custody.

In practice, there will often be two vial-cap assembly combination so that the specimen can be shipped to two laboratories for redundant testing, or a specimen can be retained to be shipped to a second laboratory in the event that the test is positive. Alternatively, one of the specimens can be retained as evidence for subsequent comparison to the shipped specimen. By providing an irreversibly locked latch, the integrity of the retained specimen is assured.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments described in the specification. As one of ordinary skill in the art will readily appreciate from the disclosure of the present invention, means and methods, or steps, presently existing or later to be developed that perform substantially the same function or achieve substantially the same result as the corresponding embodiments described herein may be utilized according to the present invention. Accordingly, the appended claims are intended to include within their scope such means, methods, and steps.

What is claimed is:

1. A method for assuring the integrity of a specimen from a donor, comprising:

providing a vial, a cap for the vial, and two latches capable of locking the cap to the vial;

locking the cap to the vial, when the vial is empty, with one of the two latches; breaking the lock;

inserting a specimen in the vial;

locking the cap to the vial with the other of the two latches; and wherein the vial has a screw thread top and the cap is screwable thereon, whereby unscrewing rotation of the cap can break either locked latch.

2. The method of claim 1 which said one of the two latches is broken in the presence of the specimen donor.

3. The method of claim 2 which the cap is locked with said other of the two latches in the presence of the specimen donor.

4. The method of claim 1 which said one of the two latches is broken in the presence of a witness who can testify as to chain of custody.

5. The method of clam 4 in which the cap is locked with said other of the two latches in the presence of a witness who can testify as to chain of custody.

6. The method of claim 1 in which there is a loop connected by a tether to the cap and formed to encircle the vial below the screw thread top, each latch having a component extending from the loop and a corresponding component extending from the cap lockable to the loop component when the cap is screwed onto the vial.

7. The method of claim 6 in which the vial is formed with at least one restraining rib spaced below its screw thread top and sized to permit the loop to be forced upwardly thereover and to thereafter restrain the loop from downward movement.

8. The method of claim 7 in which the vial is formed with a limiting flange spaced below the screw thread top and above the loop restraining rib sufficient to accommodate the loop and sized to limit upward movement of the loop.

9. The method of claim 1 in which one of the components of each of said latches is a latch staple and the corresponding component of each of said latches is a hasp.

10. The method of claim 9 in which each loop latch component is a hasp and each cap latch component is a latch staple.

11. The method of claim 1 in which each latch is irreversibly lockable.

12. A method for assuring the integrity of a specimen from a donor, comprising:

providing a vial having a screw thread top, a cap for the vial screwable thereon, a loop connected by a tether to the cap and formed to encircle the vial below the screw thread top, at least one restraining rib on the vial spaced below its screw thread top and sized to permit the loop to be forced upwardly thereover and to thereafter restrain the loop from downward movement, a limiting flange on the vial spaced below the screw thread top and above the loop restraining rib sufficient to accommodate the loop and sized to limit upward movement of the loop, and two latches capable of locking the cap to the vial, each latch having a component extending from the loop and a corresponding component extending from the cap lockable to the loop component when the cap is screwed onto the vial;

locking the cap to the vial, when the vial is empty, with one of the two latches;

unscrewing the cap whereby to break the lock in the presence of the specimen donor or in the presence of a witness who can testify as to chain of custody;

inserting a specimen in the vial; and locking the cap to the vial with the other of the two latches in the presence of the specimen donor or in the presence of a witness who can testify as to chain of custody, the other of the two latches being breakable by unscrewing rotation of the cap.

13. The method of claim 12 in which one of the components of each of said latches is a latch staple and the corresponding component of each of said latches is a hasp.

14. The method of claim 13 in which each loop latch component is a hasp and each cap latch component is a latch staple.

15. The method of claim 12 in which each latch is irreversibly lockable.

* * * * *